US010011949B2

(12) United States Patent
McKeough

(10) Patent No.: US 10,011,949 B2
(45) Date of Patent: Jul. 3, 2018

(54) METHOD FOR RECOVERING CHEMICALS AND BY-PRODUCTS FROM HIGH-SULPHIDITY PULPING LIQUORS

(71) Applicant: ANDRITZ OY, Helsinki (FI)

(72) Inventor: Paterson McKeough, Tähtelä (FI)

(73) Assignee: Andritz OY, Helsinki (FI)

( * ) Notice: Subject to any disclaimer, the term of this patent is extended or adjusted under 35 U.S.C. 154(b) by 0 days.

(21) Appl. No.: 14/761,758

(22) PCT Filed: Feb. 3, 2014

(86) PCT No.: PCT/FI2014/050082
§ 371 (c)(1),
(2) Date: Jul. 17, 2015

(87) PCT Pub. No.: WO2014/118441
PCT Pub. Date: Aug. 7, 2014

(65) Prior Publication Data

US 2016/0002853 A1 Jan. 7, 2016

(30) Foreign Application Priority Data

Feb. 4, 2013 (FI) ..... 20135105

(51) Int. Cl.
*D21C 11/00* (2006.01)
*D21C 11/12* (2006.01)
(Continued)

(52) U.S. Cl.
CPC ..... *D21C 11/12* (2013.01); *D21C 3/022* (2013.01); *D21C 11/0007* (2013.01);
(Continued)

(58) Field of Classification Search
CPC ..... D21C 3/022; D21C 3/02; D21C 11/0085; D21C 11/0035
See application file for complete search history.

(56) References Cited

U.S. PATENT DOCUMENTS 4,001,385 A * 1/1977 Sanders ..... C01B 17/34 423/576.4
4,764,597 A 8/1988 Dilling
(Continued)

FOREIGN PATENT DOCUMENTS

EP 0 903 436 3/1999
WO 00/65149 11/2000
(Continued)

OTHER PUBLICATIONS

Olm et al., High sulphidity Kraft pulp [downloaded from http://www.biocoup.com/fileadmin/user/pdf/18.03.10/39_BIOCOUP_INNVENTIA_May09.pdf], May 2009 [downloaded on Mar. 28, 2016].*
(Continued)

*Primary Examiner* — Anthony Calandra
(74) *Attorney, Agent, or Firm* — Nixon & Vanderhye P.C.

(57) ABSTRACT

A method used in connection with the recovery of pulping chemicals from spent pulping liquor produced by kraft-type pulping at very high sulphidity. In the method, spent pulping liquor is acidified to a relatively low pH which converts a most or all of the sulphide and hydrosulphide in the liquor to hydrogen sulfide. Sulphur containing gases released from the acidification of the spent pulping liquor, together with other sulphur gases collected at the pulp mill, are converted into an acid compound. This acid compound is employed as an acidification agent in the acidification of the spent pulping liquor. The amount of acid compound generated by the conversion of sulphur containing gases may be sufficient to provide most, if not all, of the acid needed for the acidification of the spent pulping liquor.

9 Claims, 2 Drawing Sheets

(51) Int. Cl.
*D21C 3/02* (2006.01)
*D21C 11/06* (2006.01)

(52) U.S. Cl.
CPC ..... *D21C 11/0035* (2013.01); *D21C 11/0085* (2013.01); *D21C 11/06* (2013.01)

(56) References Cited

U.S. PATENT DOCUMENTS

| | | | | |
|---|---|---|---|---|
| 2011/0297340 | A1 | 12/2011 | Kouisni et al. | |
| 2012/0211183 | A1* | 8/2012 | Leavitt ..... | D21C 1/04 162/37 |

FOREIGN PATENT DOCUMENTS

| | | |
|---|---|---|
| WO | 2004/013409 | 2/2004 |
| WO | 2008/079072 | 7/2008 |
| WO | 2010/143997 | 12/2010 |
| WO | 2012177198 A1 | 12/2012 |

OTHER PUBLICATIONS

Ioelovich et al., Study of Enzymatic Hydrolysis of Mild Pretreated Lignocellulosic Biomasses, 2012, Bioresources (7(1), p. 1040-1052.*

European Search Report cited in PCT/FI2014/050082, dated Jun. 3, 2014, three pages.

* cited by examiner

METHOD FOR RECOVERING CHEMICALS AND BY-PRODUCTS FROM HIGH-SULPHIDITY PULPING LIQUORS

RELATED APPLICATIONS

This application is the U.S. national phase of International Application No. PCT/FI 2014/050082 filed 3 Feb. 2014 which designated the U.S. and claims priority to FI 20135105 filed 4 Feb. 2013, the entire contents of each of which applications are hereby incorporated by reference.

TECHNICAL FIELD

The present method deals with the recovery of pulping chemicals, the recovery of by-products and the purging of non-process elements from spent pulping liquors produced in kraft-type pulping at very high sulphidity at a pulp mill.

BACKGROUND OF THE INVENTION

In the conventional kraft pulping process, the active pulping chemicals are sodium hydroxide (NaOH) and sodium sulphide ($Na_2S$). The amount of $Na_2S$ relative to the amount of NaOH is characterized by a parameter termed the sulphidity which is defined as follows:

$$\text{Sulphidity (\%)}=m_{Na2S}\times 100/(m_{NaOH}/2+m_{Na2S}),$$

where $m_{Na2S}$ the number of moles of $Na_2S$ and $m_{NaOH}$ is the number of moles of NaOH In the conventional kraft pulping process, the sulphidity of the pulping liquor is typically in the range 25-40%. In kraft-type pulping, increasing the sulphidity of the pulping liquor is usually beneficial from the point of view of the pulping stage. Typically, the upper limit on sulphidity in the conventional kraft pulping process is not set by the demands of the pulping stage but by the demands of the chemical-recovery process. When the sulphidity exceeds a certain value, sulphur dioxide ($SO_2$) emissions from the chemical-recovery boiler increase to an unacceptable level, all other process variables being unchanged. The increased $SO_2$ emission level is a consequence of the fact that the release of alkali-metal compounds from the spent pulping liquor during combustion is no longer sufficient for the capture of the greater part of the sulphur compounds released from the liquor.

Kraft-type pulping at very high sulphidity is a known pulping method. In fact, the most well-known specific method employs 100% sulphidity. In other words, in this particular method, only one active pulping chemical—$Na_2S$—is employed. This method, which was studied and developed in the late 1960s and early 1970s, goes by the name of the Alkafide process (Munk L., Todorski Z., Bryce J. R. G., Tomlinson G. H., Pulp Paper Mag. Can. 65(1964) 10, p. T411; Tomlinson G. H., Canadian Patent 725,072; Tomlinson G. H., U.S. Pat. No. 3,347,739; Ingruber O. V., Allard G. A., Pulp Paper Mag. Can. 74(1973)11, p. T354). According to these previous studies, the alkali consumption is reduced by 30-40% in Alkafide pulping compared to conventional kraft pulping. The pulp yield is reported to be the same for kraft and Alkafide pulps, while the strength properties are improved by the higher sulphidity. In other words, from the point of view of the pulping stage only, pulping at 100% sulphidity is superior to conventional kraft pulping. However, widespread commercialization of this pulping method never occurred. Presumably this was due to the lack of a cost-effective method for recovering the pulping chemical, $Na_2S$.

In present-day pulp mills based on conventional alkaline pulping processes, such as the conventional kraft pulping process, only limited amounts of by-products are recoverable in an economically viable way. These potential by-products—turpentine and tall oil—originate from the extractives component of the pulping raw material. However, the spent pulping liquor contains large quantities of other potential by-products originating from the pulping raw material. These include lignin and aliphatic hydroxy acids. In present-day alkaline pulping mills, these components are exploited as fuel in the chemical-recovery boiler. However, in recent years, interest in recovering additional by-products from spent alkaline pulping liquors has been increasing. The greatest techno-economical challenge is associated with the need to lower the pH of the spent pulping liquor in order to liberate organic compounds from their sodium salts. Utilization of purchased acid to achieve this is not an attractive option because of both the direct costs of the acid and the possible indirect costs arising from disturbances to the mill chemical balances. Ideally, the required acidification of the spent pulping liquor would be carried out with internally generated acid.

In pulp mills employing conventional alkaline pulping processes, such as the conventional kraft pulping process, potentially problematic non-process elements include silicon and phosphorus. These accumulate in the lime cycle of the mill and have a severe deleterious impact on the operability and efficiency of that cycle. (The lime cycle provides calcium oxide (CaO) for reactions in the main recovery cycle, accepts the reaction product, calcium carbonate ($CaCO_3$), and reconverts the $CaCO_3$ into CaO.) In addition, silicon compounds dissolved in the spent pulping liquor cause problems during concentration of the liquor by evaporation (higher viscosity, deposits) and combustion of the liquor (deposits). The severity of the silicon problem obviously increases with increasing content of silicon in the raw material employed for pulping. Cereal straws and certain tropical woods have high silicon contents. Silicon may be effectively removed from chemical-recovery cycle by lowering the pH of the spent pulping liquor and removing the silicon containing material thus precipitated. As in the case of recovery of by-products such as lignin, the required acidification of the spent pulping liquor would, ideally, be carried out with internally generated acid.

Use of internally generated acid has previously been proposed for acidification of spent pulping liquor. The main emphasis has been on the exploitation of carbon dioxide ($CO_2$) contained in flue gases. $CO_2$, a weak acid, is effective in lowering the pH of spent alkaline pulping liquor to around 10, which is sufficient to precipitate a significant amount of the lignin contained in the liquor, thus allowing recovery of lignin as a by-product. Similarly, several known methods for purging silicon from the chemical-recovery cycle are based on the use of $CO_2$ for acidifying the spent pulping liquor. One approach has been to use flue gas as such as the acidifying medium. This approach has not led to any long-lived commercial applications. Another approach is to remove $CO_2$ from flue gases and use the recovered $CO_2$ in a concentrated form. This approach has proved too costly. Use of purchased $CO_2$ for acidifying spent pulping liquor to a pH around 10 is the basis of several current processes for recovering lignin from spent pulping liquor.

At a conventional kraft pulping mill, one stream that is readily convertible into acid is the stream made up of concentrated non-condensable gases (CNCG) collected as a side-product from several mill operations, in particular from pulping and evaporation operations. Sulphur containing compounds, in particular hydrogen sulphide ($H_2S$), methyl mercaptan ($CH_3SH$) and dimethyl sulphide ($(CH_3)_2S$), are main components in these gases. Oxidation of these gases yields an acidic compound, sulphur dioxide ($SO_2$), which may be further converted into the strong mineral acid, sulphuric acid ($H_2SO_4$). However, the amount of acid that could be produced in this way is relatively small, which may explain why acid generated from CNCG has not, in general, been proposed for acidifying spent kraft pulping liquor. Typically, the amount of sulphur contained in the total CNCG stream of the pulp mill could provide enough $H_2SO_4$ to acidify less than 5% of the total spent pulping liquor to a pH of 10. In a method disclosed in US Patent Application US2008/0214796A1, acid generated from CNCG is used for washing lignin precipitated from spent kraft pulping liquor, while $CO_2$ is employed for the preceding acidification step.

In a method disclosed in Patent Application WO2010/143997A1, gases, mainly $CO_2$ and $H_2S$, are recycled from the acidic washing stage of a lignin-recovery process to the precipitation stage of the same lignin-recovery process. Being acidic gases, the recycled $CO_2$ and $H_2S$ can reduce, to some extent, the amount of external acid, typically $CO_2$, employed to acidify spent pulping liquor in the precipitation stage. In one of the embodiments of the method, the recycled $H_2S$ is first converted into stronger acid such as $H_2SO_4$. It is important to note that (1) a very minor or negligible amount of $H_2S$ is released in the acidification stage of this method, (2) in the example given in the patent document, a significant part of the savings in acid consumption in the precipitation stage is attributable to recycled $CO_2$ rather than to recycled $H_2S$ and (3) the amount of input acid required in the acidic washing stage—measured in terms of amount of $H^+$ ions—clearly exceeds the amount of acid that could be supplied by utilizing or converting all the $CO_2$ and $H_2S$ released in the same acidic washing stage. Thus, the amount of $H_2S$ recycled in this method is much less than the amount that would be necessary to cover all the acid consumed in the process even if the $H_2S$ were to be first converted to a stronger acid such as $H_2SO_4$.

In the light of the prior art, there is a clear need for:

1. a technically and economically viable method for recovering pulping chemicals in conjunction with kraft-type pulping at very high sulphidity, and
2. a technically and economically viable method for internally generating, on a large scale, acid for lowering the pH of spent alkaline pulping liquor and thus facilitating the recovery of by-products and/or the removal of certain non-process elements from the liquor.

An object of the present invention is to provide a method which can meet both these needs simultaneously.

DESCRIPTION OF THE INVENTION

This object is attained by means of a method according to claim 1.

The present invention is a new method to be used in connection with the recovery of pulping chemicals from the spent pulping liquor produced by kraft-type pulping at very high sulphidity. In the new method, spent pulping liquor is acidified with internally generated acid to a relatively low pH, preferably below 7, most preferably below 6. The acidification of the spent pulping liquor may be exploited as a means to increase recovery of by-products and/or to purge non-process elements from the chemical-recovery cycle.

Kraft-type pulping can be considered to be conducted under conditions of very high sulphidity when the sulphidity of the pulping liquor is greater than 40%. For the purposes of the present new method, the sulphidity is preferably in the range 50-100%, most preferably in the range 70-100%.

Two problems which the invention set out to solve were:

the lack of a cost-effective method for recovering pulping chemicals from the spent pulping liquor produced by kraft-type pulping at very high sulphidity, this lack having curtailed commercial exploitation of the advantages of employing very high sulphidity in the pulping stage, and the lack of a cost-effective method for internally generating acid in sufficient quantity to acidify a large part of the spent pulping liquor produced by an alkaline pulping process to the extent necessary to allow significant recovery of by-products, such as lignin, and/or significant removal of non-process elements, such as silicon.

The present invention can provide solutions to both these problems.

When a pH value is referred to herein, it is the pH of the solution in question at 25° C.

The key idea behind the present invention is an entirely new type of adjunct chemical-recovery cycle for kraft-type pulping. A very high level of sulphidity in the pulping stage is a precondition for application of the new adjunct cycle. In the chemical-recovery process employed in conjunction with conventional kraft pulping, the lime cycle constitutes an adjunct cycle. In the overall chemical-recovery process that would incorporate the new adjunct cycle, the required capacity of the lime cycle would be decreased remarkably. In some cases, the lime cycle could be eliminated entirely.

The new adjunct cycle (1) takes up sulphur gases, primarily composed of $H_2S$ and primarily generated by acidifying the spent pulping liquor to the extent necessary to convert a large part, such as over 75%, or all, of the sulphide and hydrosulphide in the liquor into $H_2S$, and, preferably together with other CNCG gases collected at the pulp mill, (2) converts these gases largely into an acid compound, preferably $H_2SO_4$, and then (3) returns the acid for use as the main agent for the previously mentioned acidification of the spent pulping liquor. The amount of acid generated in the cycle is sufficient to provide most, if not all, of that required for the acidification step. In certain methods of the prior art, e.g. as disclosed in patent applications US2008/0214796A1 and WO2010/143997A1, acid is internally generated from $H_2S$ released from spent pulping liquor but, in all cases, the amount of acid is much smaller than the amount which would be needed to establish an adjunct cycle as described above.

Acidic compounds may be generated from sulphur containing materials via their oxidation. Such acidic compounds include $SO_2$, sodium bisulphite ($NaHSO_3$) and $H_2SO_4$. From the point of view of the present invention, $H_2SO_4$ is the preferred acidic compound because a pH below 7 can be readily reached with two $H^+$ ions being supplied for each sulphur atom. The most well-known process for producing concentrated $H_2SO_4$ from reduced sulphur gases, such as $H_2S$, encompasses the following main steps: (1) combustion of reduced sulphur gases to form $SO_2$, (2) recovering heat from hot gases (steam generation), (3) catalytic oxidation of $SO_2$ into sulphur trioxide ($SO_3$) and (4) absorption of $SO_3$ in strong acid ($H_2SO_4$).

For convenience, this new adjunct cycle is herein referred to as the $H_2S$—$H_2SO_4$ cycle.

In aqueous solution, $H_2S$ has two dissociation states described by the following reactions:

$$H_2S \leftrightarrow HS^- + H^+ \quad (1)$$

$$HS^- + H^+ \leftrightarrow S^{2-} + 2H^+ \quad (2)$$

In the case of Reaction 1, the value of the logarithmic acid-dissociation constant, $pK_a$, is close to 7 at 25° C. When the pH is the same as the $pK_a$ value for this reaction, the concentration of molecular $H_2S$ is equal to that of hydrosulphide ion ($HS^-$). For Reaction 2, various $pK_a$ values are reported in the literature with perhaps a value of about 13 at 25° C. being the most widely accepted. In any case, any sulphide ion ($S^{2-}$) present in the spent pulping liquor is converted into hydrosulphide ion at an early stage in the acidification of the liquor. From the point of view of the present invention, the critical reaction is Reaction 1—the conversion of hydrosulphide ion ($HS^-$) into molecular $H_2S$. From the $pK_a$ value for Reaction 1, it may be concluded that, in order to convert a large part of the hydrosulphide ion contained in spent pulping liquor into molecular $H_2S$, the pH of the liquor has to be decreased to a value preferably below 7, most preferably below 6.

The $H_2S$—$H_2SO_4$ cycle cannot be realized in conjunction with the level of sulphidity employed in the conventional kraft pulping process. At a sulphidity level of 40%, i.e. at the high end of the range typically used in kraft pulping, converting all the sulphide/hydrosulphide in the spent pulping liquor into $H_2S$ and then converting all this $H_2S$ into $H_2SO_4$ would produce enough acid to lower the pH of the original spent pulping liquor to a value of around 10, but no further. With Reaction 1 having a $pK_a$ value of around 7, only a very small amount of sulphide/hydrosulphide—almost negligible in comparison to the total amount available—is converted into molecular $H_2S$ at pH 10. The higher the sulphidity, the more sulphide/hydrosulphide is available. A significant jump in sulphidity is required in order to reach the sulphidity range in which the $H_2S$—$H_2SO_4$ adjunct cycle is feasible. At a sulphidity level somewhere above 50%, a balanced, or nearly balanced, $H_2S$—$H_2SO_4$ cycle becomes feasible. It is not possible to specify a universal threshold value for the sulphidity level which enables the $H_2S$—$H_2SO_4$ cycle to be feasible. The threshold value is very case-specific depending on a wide range of process parameters. These include the extents of certain side-reactions of sulphide/hydrosulphide, discussed further below.

On the basis of the prior art, it is not to be expected that, in the case of pulping at very high sulphidity, the amount of $H_2SO_4$ generated in the $H_2S$—$H_2SO_4$ cycle is sufficient to provide most, if not all, of that required for the acidification step. Firstly, given the problem of developing a method for recovering pulping chemicals from spent pulping liquor of higher-than-normal sulphidity, a solution based on the novel $H_2S$—$H_2SO_4$ cycle, which is impossible to realize at normal sulphidity, is not likely to enter the mind of a person skilled in the art. Secondly, although it is true that higher-sulphidity black liquors contain more sulphide ($S^{2-}$) and/or hydrosulphide ions ($HS^-$) and thus these liquors have the potential to release more $H_2S$, the presence of more $S^{2-}/HS^-$ ions also means that more acid is needed to react with those ions in order to release the $H_2S$ associated with them. Thirdly, as presented in more detail below, $S^{2-}/HS^-$ ions are consumed in a number of reactions during pulping and recovery operations, and, on the basis of the prior art, it is difficult to predict the extents of some of these reactions even at normal sulphidity levels. On the basis of the prior art, it is extremely difficult, or even impossible, to predict the extents of all these reactions under conditions of higher-than-normal sulphidity. Overall, if a person skilled in the art were to assume anything, it would be that achieving a balanced $H_2S$—$H_2SO_4$ cycle at high sulphidity is not likely to be any easier than it is at normal sulphidity.

Although the use of $Na_2S$ as a pulping chemical has a major influence on pulping chemistry, the delignification reactions, as such, do not lead to a measurable net consumption of sulphide/hydrosulphide. In kraft-type pulping, sulphide/hydrosulphide is consumed to some extent in the following types of side-reactions (shown for the case of hydrosulphide):

Lignin demethylation: $\text{Lignin-OCH}_3 + HS^- \rightarrow \text{Lignin-O}^- + CH_3SH$ (3)

{plus follow-on reaction: $\text{Lignin-OCH}_3 + CH_3S^- \rightarrow \text{Lignin-O}^- + (CH_3)_2S$} (4)

Sulphur combining organically with lignin; stoichiometric representation (actual reactions unknown): $\text{Lignin} + HS^- + OH^- \rightarrow \text{Lignin-S} + H_2O$ (5)

Oxidation: $2HS^- + 2O_2 \rightarrow S_2O_3^{2-} + H_2O$ (6)

$$HS^- + OH^- + 3/2O_2 \rightarrow SO_3^{2-} + H_2O \quad (7)$$

Reactions 3 and 4, which yield sulphur containing gas compounds, are not problematic from the point of view of the present invention because, in preferred embodiments of the invention, these gases are collected and inputted into the $H_2S$—$H_2SO_4$ cycle together with the sulphur gases released during acidification of the spent pulping liquor. Reactions 5, 6 and 7, on the other hand, reduce the amount of sulphide/hydrosulphide that is available for conversion into $H_2S$ through acidification of the spent pulping liquor. Fortunately, only a relatively small part of the total sulphide/hydrosulphide in the pulping liquor is consumed in Reactions 5, 6 and 7.

Reactions 5, 6 and 7 are most problematic in the case when the sulphidity level employed in the pulping stage is at or near 100%. In the absence of these side-reactions, the $H_2S$—$H_2SO_4$ cycle could, in this case, be operated with little or no addition of make-up $H_2SO_4$. In other words, the amount of sulphur in the collected gases would be close to the amount of sulphur in the $H_2SO_4$ employed for acidifying the spent pulping liquor. However, Reactions 5, 6 and 7 all increase the need for make-up $H_2SO_4$ when the pulping sulphidity is at or near 100%.

At somewhat lower sulphidities, Reactions 5, 6 and 7 are less problematic. In a typical embodiment of the present invention employing a sulphidity level around 80%, a balanced, or nearly balanced, $H_2S$—$H_2SO_4$ cycle is possible despite the occurrence of Reactions 5, 6 and 7. As discussed further below, the spent pulping liquor need not be acidified to as low a pH as that required in the 100% sulphidity case. In other words, less $H_2SO_4$ is required.

Looking to the new method as a whole, it can be stated that the amount of $H_2SO_4$ that is generated from $H_2S$ released during the acidification of the spent pulping liquor, when such $H_2S$ is preferably further augmented by sulphur gases released in other pulp-mill operations, is typically sufficient to provide from 75% to 100% of the acid required for the previously mentioned acidification step.

Incorporation of the $H_2S$—$H_2SO_4$ adjunct cycle results in a large part, or all, of the both the hydrosulphide ion and the sulphide ion in the spent pulping liquor being replaced by sulphate ion. The reaction between sodium hydrosulphide (NaHS) and $H_2SO_4$ is the following:

$$2NaHS + H_2SO_4 \rightarrow Na_2SO_4 + 2H_2S \quad (8)$$

Sulphur is not released to a significant extent from sulphate salts during subsequent combustion of the spent pulping liquor. This, in turn, means that the combustion of the liquor can be carried out in a recovery boiler—of similar type to the boiler employed in the conventional kraft recovery process—without excessive emission of $SO_2$. In other words, incorporation of the new $H_2S$—$H_2SO_4$ adjunct cycle overcomes the earlier obstacle and allows the chemicals employed in kraft-type pulping at very high sulphidities to be recovered in a cost-effective way.

When the sulphidity employed in the pulping stage is at or near 100%, all, or nearly all, of the sodium in the spent pulping liquor needs to be in the form of sodium sulphate ($Na_2SO_4$) after the acidification of the liquor. This necessitates that the spent pulping liquor is acidified to a relatively low pH value, e.g. pH 3. In the furnace of the recovery boiler, nearly all this $Na_2SO_4$ ends up on the char bed where it is, to a large extent, reduced to $Na_2S$. So the smelt exiting the furnace is mainly composed of $Na_2S$, together with some unreduced $Na_2SO_4$. Pulping liquor is prepared by dissolving the smelt in water and/or aqueous solution.

When a somewhat lower sulphidity is employed in the pulping stage, say 80%, it is sufficient to acidify the spent pulping liquor to the extent necessary to convert sodium sulphide/hydrosulphide into $H_2S$ and $Na_2SO_4$. The final pH need not be as low as in the case of 100% sulphidity and is typically in the range 5-6. In this case, the smelt exiting the recovery furnace contains $Na_2CO_3$ in addition to the main component, $Na_2S$, as well as some unreduced $Na_2SO_4$, and the liquor produced by dissolving this smelt is not, in general, ready for direct recycling to the pulping stage. As in the conventional kraft recovery process, $Na_2CO_3$ should preferably be first converted into NaOH by exploiting the causticization reaction. Thus, in a case where the pulping sulphidity is distinctly less than 100% but nonetheless very high, the recovery process generally still includes a causticization operation and a lime cycle. Note that the required causticizing capacity, and so the capacity of the lime cycle, are much smaller than those in the corresponding recovery process after conventional kraft pulping. (As in the case of conventional alkaline pulping, the lime cycle may be partially or fully opened up thereby reducing the capacity of, or eliminating, the lime kiln.) As already explained above, elimination of the causticization operation and the lime cycle is possible when pulping at a sulphidity level at or near 100%.

In certain embodiments of the present invention, the new adjunct $H_2S$—$H_2SO_4$ cycle is applied without any withdrawal of by-products and/or of non-process elements in conjunction with the acidification of the spent pulping liquor. On the other hand, incorporation of the recovery of byproducts and/or the purging of non-process elements is advantageous in many cases. Lignin precipitation is already significant at pH 10, so lignin recovery is readily realized in conjunction with the present invention. Note that there is no need to recovery all the lignin that is precipitated during the acidification steps. Certain lignin fractions may be withdrawn from the recovery cycle, others may be combusted in the recovery boiler. If the purging of a non-process element, such as silicon, is a primary aim, only such precipitate fractions that contain a major portion of the non-process element need be removed from the cycle. The acidification process may be carried out in a stepwise manner. By-products may be recovered and/or non-process elements may be removed after, or in conjunction with, any or all of the steps. The spent pulping liquor is concentrated by evaporation before being combusted in the recovery boiler. The evaporation process may be carried out in one or more steps before and/or after any or all of the acidification steps.

Recovery of aliphatic acids in conjunction with the acidification of the spent pulping liquor is not as straightforward as the recovery of lignin. The reason is the low pH level that must be reached in order to liberate these acids from their sodium salts. Recovery of aliphatic acids is easier in the case of a pulping sulphidity at or near 100%. In this case, the low final pH required in the acidification process, e.g. pH 3, is sufficient to liberate all, or nearly all, of the aliphatic acids from their salts. In the case of a pulping sulphidity around, say, 80%, at least some of the aliphatic acids are still bound to sodium at the final pH, e.g. pH 5, employed in the acidification stage. In this case, a cost-effective way to recover aliphatic acids might incorporate the use of purchased $H_2SO_4$ to further lower the pH of a part of the pulping liquor from e.g. pH 5 to e.g. pH 3.

Although both the recovery boiler and the recovery-boiler process employed in conjunction with the present method have many features in common with the recovery boiler and recovery-boiler process employed at a conventional kraft pulp mill, there are some clear differences as well. Firstly, as a result of a much higher proportion of $Na_2S$ in the smelt, endothermic reduction reactions in the char bed consume more heat than in the corresponding conventional process. Thus—in the recovery boiler at least—less heat is recovered as steam. On the other hand, this deficit is at least partially offset by steam generated in conjunction with the conversion of sulphur containing gases into $H_2SO_4$. In cases where significant amounts of by-products are recovered in connection with the acidification of the spent pulping liquor, the ratio of combustibles to inorganics in the final spent pulping liquor is clearly lower than the corresponding ratio in the typical spent pulping liquor of the conventional kraft process. In order to achieve an acceptable combustion temperature in the recovery boiler in the case of significant by-product recovery, use of auxiliary fuel in the boiler may be necessary.

In one embodiment of the invention, the spent pulping liquor from the pulping stage is split into two or more streams and one or more by-products and/or one or more non-process elements are removed to different extents from the different spent pulping liquor streams before possible recombination of the streams further downstream.

In another embodiment employing a split of the spent pulping liquor stream, the stream is split into two, but in this case only one of these streams is acidified according to the new method. The acidified stream is, after possible recovery of by-products and/or removal of non-process elements, recombined with the other stream at some location upstream of the recovery boiler. The idea behind this embodiment is that the $SO_2$ level in the flue gas of the recovery boiler can be kept at an acceptably low level if the content of $S^{2-}/HS^-$ in the recombined spent pulping liquor stream is not significantly higher than it is in the case of pulping at conventional sulphidity levels. With a conventional level of $S^{2-}/HS^-$ in the liquor fired in the boiler, the extent of capture of the sulphur released into the gas stream in the furnace will be similar to that encountered in a conventional kraft recovery furnace. This situation is, for example, approached if (1) pulping is carried out at a sulphidity level of about 80%, (2) the pulping liquor is split into two streams of roughly equal flow, (3) the new method is applied to only one of the streams and (4) the two streams are recombined prior to combustion in the recovery boiler. Obviously, the split ratio for the spent pulping liquor may be fine-tuned to ensure that the $S^{2-}/HS^-$ content in the black liquor to be fired in the boiler does not exceed the critical level. Compared to some of the other embodiments of the new method, operations in the evaporation and recovery-boiler areas deviate less from those of a conventional kraft mill.

In yet another embodiment of the invention, the pulping process at very high sulphidity is employed to complement a conventional kraft pulping process. The pulping process at very high sulphidity may, in this case, be applied in parallel with the conventional kraft pulping process or, for example, it may be applied as a pre-pulping step, possibly combined with an impregnation operation, prior to the conventional kraft pulping process. The spent pulping liquor exiting the pulping stage operated at very high sulphidity is subjected to the recovery method of the present invention and, preferably, one or more byproducts are recovered from this liquor. Further downstream, this spent pulping liquor is combined with the spent pulping liquor from the conventional kraft pulping stage and, after any necessary concentration of the combined spent pulping liquor, the combined liquor is combusted in a recovery boiler. The regeneration of the pulping liquors requires an extra operation in this embodiment. Namely, the liquor stream arising from the dissolution of the smelt exiting the recovery boiler needs to be split into a liquor of conventional sulphidity, e.g. 35%, and a liquor of very high sulphidity. One of the ways to achieve this split exploits crystallization in conjunction with evaporation. The split may be realized before or after the causticization operation.

In a case where the pulping sulphidity is distinctly less than 100% but nonetheless very high, finding a sulphidity level which leads to a balanced $H_2S$—$H_2SO_4$ cycle is relatively straightforward. If a sulphidity level of 80% is expected to be suitable, this level would be applied initially. In the start-up phase, purchased $H_2SO_4$ would be used for the acidification of the spent pulping liquor. If, after some time, it becomes evident that the amount of $H_2S$ and other sulphur containing gases is insufficient for generating the required amount of $H_2SO_4$, more purchased $H_2SO_4$ would be inputted to the cycle. The additional $H_2SO_4$ input would also increase the steady-state sulphidity level in the main recovery cycle. In this way, the sulphidity level required for a balanced $H_2S$—$H_2SO_4$ cycle—a sulphidity somewhat greater than 80% in this example—would be established. Conversely, should excess $H_2SO_4$ be generated in the $H_2S$—$H_2SO_4$ cycle, some of the acid would be withheld and a steady-state sulphidity level somewhat lower than that of the initial 80% level would be established.

At a conventional kraft pulping mill, tall-oil soap is often separated from the spent pulping liquor at some stage during the concentration of the liquor by evaporation. The tall-oil soap thus separated is usually acidified, and usually using $H_2SO_4$, in order to recover the by-product, tall oil. Recovery of tall oil may be carried out in conjunction with recovery processes incorporating the new method. Obviously, since a significant amount of internally produced acid is provided by the new method, there is a possibility to achieve savings in production costs compared to those of tall-oil recovery at a conventional kraft pulping mill.

BRIEF DESCRIPTION OF THE DRAWINGS

The present new method is described in more detail with reference to the drawings, FIGS. 1-3, each depicting one embodiment of the invention. The numbers and letters in the figures refer to the following streams and processing stages:

1. Raw material for pulping, such as wood chips or straw
2. Washed pulp
3. Spent pulping liquor
4. Spent pulping liquor
5. Spent pulping liquor
6. Spent pulping liquor
7. Processed spent pulping liquor/slurry
8. Processed spent pulping liquor/slurry
9. Concentrated $H_2SO_4$
10. Processed spent pulping liquor/slurry
11. Concentrated $H_2SO_4$
12. Concentrated $H_2SO_4$
13. Sulphur containing gases
14. Sulphur containing gases
15. Sulphur containing gases
16. Sulphur containing gases
17. Sulphur containing gases
18. Sulphur containing gases
19. Sulphur containing gases
20. Auxiliary fuel
21. Smelt
22. Water and/or aqueous solution
23. Liquor stream from smelt dissolving stage
24. Regenerated pulping liquor
25. Lignin slurry
26. Filtrate
27. Processed filtrate/slurry
28. Filtrate from lignin washing
29. Washed lignin
30. Make-up $H_2SO_4$
31. Spent pulping liquor
A. Stage encompassing pulping and pulp washing
B1. Evaporation stage
B2. Evaporation stage
C1. Acidification stage
C2. Acidification stage
D. $H_2SO_4$ production plant
E. Flashing and/or stripping stage
F. Recovery boiler
G. Smelt dissolving stage
H. Causticization process, including lime slaking, filtration and lime-stone mud washing
I. Lime kiln
J. Filtration stage
K. Washing stage

DESCRIPTION OF PREFERRED EMBODIMENTS

Figure 1:
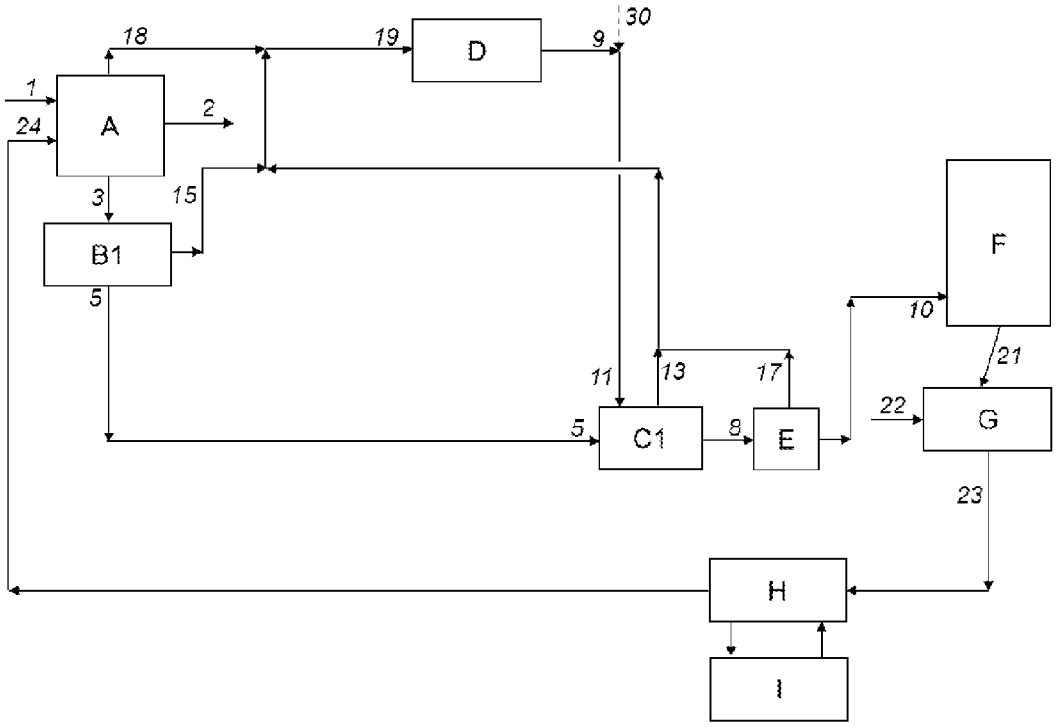

The embodiment depicted in FIG. 1 does not incorporate recovery of by-products or purging of non-process elements in conjunction with the acidification of the spent pulping liquor. The raw material for the pulping process (1), e.g. wood in the form of chips, is subjected to kraft-type pulping at around 80% sulphidity in stage A, which also includes the pulp-washing operation. Washed pulp (2) exits the stage and is further processed as necessary. The spent pulping liquor (3) exiting stage A is concentrated by evaporation in stage B1 before being subjected to acidification to a pH below 6 in stage C1. The acidifying agent (11) is concentrated $H_2SO_4$, most, or all, of which is produced on site in stage D. As a result of lignin precipitation, the spent pulping liquor is in the form of dense slurry after the acidification stage (C1). This slurry (8) is subjected to a flashing and/or stripping stage (E) in order to maximize release of the molecular $H_2S$ formed in the acidification stage. Sulphur containing gases (13, 17), comprised particularly of $H_2S$, are collected from the acidification stage (C1) and the flashing/stripping stage (E), and are combined with sulphur containing CNCG gases (15, 18) from the evaporation stage (B1) and the pulping stage (A). The combined sulphur-gas stream (19) is converted into concentrated $H_2SO_4$ in the $H_2SO_4$ production plant (D) known per se. Make-up $H_2SO_4$ (30) is inputted to the $H_2S$—$H_2SO_4$ cycle as necessary. The spent pulping slurry (10) exiting the flashing/stripping stage (E) is combusted in a recovery boiler (F) of similar type to the boiler employed in the conventional kraft recovery process. As in the conventional process, fly-ash is separated from the flue gas by e.g. an electrostatic precipitator and recycled. The main component in the smelt (21) exiting the boiler is $Na_2S$, while another significant component is $Na_2CO_3$. Complete reduction of $Na_2SO_4$ to $Na_2S$ is not expected in the recovery furnace, so the smelt generally contains some $Na_2SO_4$, as well, not to mention other minor components. Water and/or an aqueous solution such as weak white liquor (22) is used to dissolve the smelt in stage G. The liquor so formed (23) is subjected to causticization in stage H in order to convert the greater part of its $Na_2CO_3$ into NaOH. The causticizing capacity, and so the capacity of the lime kiln (I), are much smaller than those of the corresponding conventional kraft recovery process. After causticization, the liquor is ready for reuse as the pulping liquor (24) in stage A.

Another embodiment, exploiting a pulping sulphidity at or near 100% sulphidity, has many features in common with that depicted in FIG. 1. In addition to the higher sulphidity level, significant differences compared to the embodiment of FIG. 1 are:

- acidification is carried out to a lower pH, e.g. pH 3
- more $H_2SO_4$ make-up is required; at least part of the sulphur consumed in Reactions 5, 6 and 7 needs to be made up
- the causticization stage and the lime cycle are eliminated.

Figure 2:
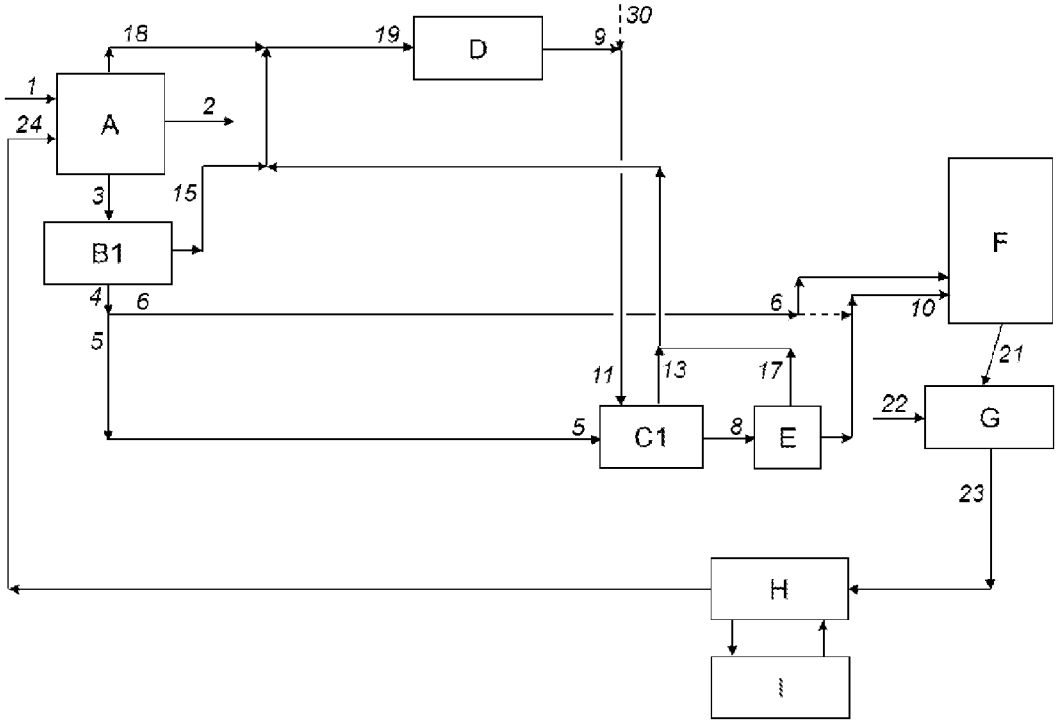

The embodiment depicted in FIG. 2 differs from that depicted in FIG. 1 in that the concentrated spent pulping liquor (4) is split into two streams (5, 6). Stream 5 is processed in the same way as in the embodiment of FIG. 1. Stream 6 is not subjected to acidification but is led instead directly to the recovery boiler (F), where it is combusted either as a separate stream or as mixed with the concentrated spent pulping slurry (10). The split of the spent pulping liquor into two streams (5, 6) is such that the level of $SO_2$ in the flue gas of the recovery boiler remains at an acceptable level.

Figure 3:
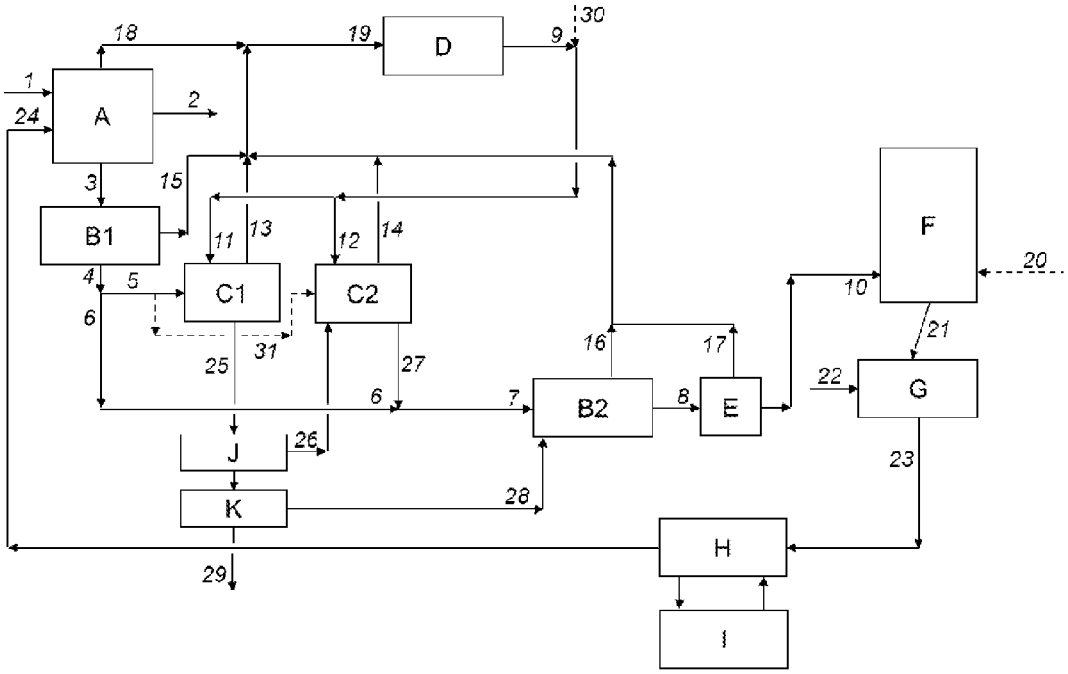

The embodiment depicted in FIG. 3 incorporates recovery of by-product lignin. In many other respects it is similar to the embodiment depicted in FIG. 2. After the first evaporation stage (B1), the spent pulping liquor (4) is split into two streams (5, 6) in the same way as in the embodiment of FIG. 2. Stream 5 is first acidified to a pH of around 9 in stage C1 using concentrated $H_2SO_4$ (11) from the $H_2S$—$H_2SO_4$ cycle. The lignin slurry (25) exiting stage C1 is subjected to filtration in stage J. The filtrate (26) from stage J is acidified further to a pH below 6 in stage C2 using concentrated $H_2SO_4$ (12) from the $H_2S$—$H_2SO_4$ cycle. The sulphur containing gases (13, 14) exiting stages C1 and C2 are collected to be part of the sulphur-gas stream that is fed to the $H_2SO_4$ production plant (D). From stage C2, the processed filtrate (27), in the form of slurry, is mixed with the non-acidified stream (6) of spent pulping liquor. The pH of the mixed spent pulping liquor stream (7) is only a little lower than that of the non-acidified spent pulping liquor (6). Solids in stream (27) re-dissolve when the stream is mixed with the non-acidified liquor (6). Lignin filter cake from stage J is washed in at least two steps in stage K, thus yielding the desired by-product—washed lignin (29). At least one washing step is conducted under acidic conditions using $H_2SO_4$. Filtrate (28) from the lignin-washing stage K is led to the evaporation stage B2. Other features of the embodiment depicted in FIG. 3 are similar to the corresponding features of the embodiment depicted in FIG. 2. The higher the extent of withdrawal of by-product lignin, the more likely is the need for auxiliary fuel (20) in the recovery boiler (F). Obviously the extent of withdrawal of lignin can be decreased by bypassing the first acidification stage (C1), i.e. by leading part (31) of stream 5 directly to the second acidification step (C2).

EXAMPLE

Mass flows of the main components in various streams of an example recovery process incorporating the new method are given in the following Tables 1-5. The example recovery process does not incorporate withdrawal of by-products or non-process elements in conjunction with the acidification of the spent pulping liquor. The acidification process is applied to the whole stream of spent pulping liquor. Where applicable, the flows are compared to those of a reference conventional kraft recovery process. In the case of the new method, pulping of softwood is carried out at 80% sulphidity and 17.5% EA (effective alkali as NaOH on wood), while, in the reference process, softwood pulping is carried out at 35% sulphidity and 19.5% EA. Other key assumptions are: (1) $Na_2S$ is completely hydrolyzed in the pulping liquor, i.e. sulphide is completely converted to hydrosulphide according to Reaction 2, (2) the reduction efficiency in the recovery furnace is 95% and (3) the causticization degree is 85%. The unit of mass flow is kg per air-dried metric ton of pulp (kg/ADt).

TABLE 1

Mass flows of liquor components after pulping, kg/ADt of pulp

| | Sulphidity 35% EA 19.5% Conventional kraft process | Sulphidity 80% EA 17.5% High-sulphidity pulping and new recovery process |
|---|---|---|
| NaOH | 65 | 38 |
| NaHS | 92 | 277 |
| $Na_2CO_3$ | 71 | 27 |
| $Na_2SO_4$ | 15 | 44 |
| $Na_2S_2O_3$ | 1 | 9 |
| Na in lignin | 53 | 58 |
| Na in acids | 139 | 139 |
| S in lignin | 10 | 18 |
| Organics | 1140 | 1140 |
| Total solids | 1585 | 1750 |

TABLE 2

Mass flows of liquor components after acidification, kg/ADt of pulp

| | Sulphidity 80% EA 17.5% High-sulphidity pulping and new recovery process |
|---|---|
| $Na_2SO_4$ | 819 |
| $Na_2S_2O_3$ | 9 |
| Na in lignin | 0 |
| Na in acids | 92 |
| S in lignin | 18 |
| Organics | 1140 |
| Total solids | 2080 |

TABLE 3

Mass flows of components in the $H_2S$—$H_2SO_4$ cycle, kg/ADt of pulp

| | Sulphidity 80% EA 17.5% High-sulphidity pulping and new recovery process |
|---|---|
| S in $H_2S$ from acidification | 158 |
| S in other collected CNCG gases | 7 |
| $H_2SO_4$ produced from S gases | 505 |
| $H_2SO_4$ make-up | 30 |
| $H_2SO_4$ consumed in acidification | 535 |

TABLE 4

Mass flows of compounds in recovery-boiler smelts, kg/ADt of pulp

| | Sulphidity 35% EA 19.5% Conventional kraft process | Sulphidity 80% EA 17.5% High-sulphidity pulping and new recovery process |
|---|---|---|
| $Na_2S$ | 158 | 456 |
| $Na_2SO_4$ | 15 | 44 |
| $Na_2CO_3$ | 470 | 181 |
| Total | 645 | 680 |

TABLE 5

Mass flows of compounds in the regenerated pulping liquors, kg/ADt of pulp

| | Sulphidity 35% EA 19.5% Conventional kraft process | Sulphidity 80% EA 17.5% High-sulphidity pulping and new recovery process |
|---|---|---|
| $Na_2S$ | 158 | 456 |
| NaOH | 302 | 116 |
| $Na_2SO_4$ | 15 | 44 |
| $Na_2CO_3$ | 71 | 27 |
| Total solids | 545 | 645 |

The embodiments of the present invention are not limited to those mentioned or described herein.

The invention claimed is:

1. A method to be used in connection with recovery of pulping chemicals from spent pulping liquor produced by kraft-type alkaline pulping at a sulphidity in a range of 50 percent to 100 percent, the method comprising:

a) acidifying at least part of spent pulping liquor in one or more stages to a pH low enough to convert both hydrosulphide ions and the sulphide ions in the spent pulping liquor into hydrogen sulphide, b) converting to an acid compound sulphur containing gases released in the acidification process of step a), wherein the sulphur containing gases comprise hydrogen sulphide;

c) the acid compound generated in step b) is employed in step a) and the amount of the acid compound generated in step b) is sufficient in quantity to provide at least most of the acid required in step a);

d) after the release of the sulphur containing gases in step b), combusting the spent pulping liquor containing sodium sulphate in a recovery boiler;

e) generating smelt containing sodium sulfide from the combustion in step d);

f) dissolving the smelt in a liquid, and g) using the dissolved smelt to produce a pulping liquor.

2. The method as in claim 1, wherein the pH reached in the acidification step is below 7.

3. The method as in claim 1, wherein, in conjunction with the acidification of the spent pulping liquor in step a), one or more by-products are partially or totally recovered from the liquor and/or one or more non-process elements are partially or totally removed from the liquor.

4. The method as in claim 1, wherein the acidification of the spent pulping liquor is carried out in a stepwise manner and one or more by-products are partially or totally recovered and/or one or more non-process elements are partially or totally removed.

5. The method as in claim 1 the spent pulping liquor is combusted in a chemical-recovery boiler after step a).

6. The method as in claim 5, further comprising applying an evaporation process to the spent pulping liquor before step a).

7. The method as in claim 1, wherein the spent pulping liquor is from a pulping stage and is split into two or more streams and at least one by-produce or non-process element is removed from one of the streams of the spent pulping liquor.

8. The method as in claim 1, wherein the spent pulping liquor is from a pulping stage, and the spent pulping liquor is split into streams, and steps a), b) and c) are applied to at least one of the streams but not to all of these streams.

9. A method to be used in connection with recovery of pulping chemicals from spent pulping liquor produced by kraft-type alkaline pulping at a sulphidity of 50% or greater and complements a kraft pulping process, the method comprising:

a) acidifying at least part of spent pulping liquor in one or more stages to a pH low enough to convert both hydrosulphide ions and the sulphide ions in the spent pulping liquor into hydrogen sulphide, b) converting to an acid compound sulphur containing gases released in the acidification process of step a), wherein the sulphur containing gases comprise hydrogen sulphide, and c) the acid compound generated in step b) is employed in step a) and the amount of the acid compound generated in step b) is sufficient in quantity to provide at least most of the acid required in step a), at least part of the chemical-recovery process being common to both the very high sulphidity process and the kraft pulping process.

* * * * *